US009765616B2

(12) United States Patent
Kim et al.

(10) Patent No.: US 9,765,616 B2
(45) Date of Patent: Sep. 19, 2017

(54) APPARATUS FOR SAMPLING WATER IN BOREHOLE, AND METHOD THEREOF

(71) Applicant: KOREA INSTITUTE OF GEOSCIENCE AND MINERAL RESOURCES, Deajeon (KR)

(72) Inventors: Jeong-Chan Kim, Daejeon (KR); Ki-Sung Sung, Incheon (KR); Gi-Tak Chae, Yongin-si (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 593 days.

(21) Appl. No.: 14/183,285

(22) Filed: Feb. 18, 2014

(65) Prior Publication Data

US 2015/0000906 A1 Jan. 1, 2015

(30) Foreign Application Priority Data

Jul. 1, 2013 (KR) ..... 10-2013-0076468

(51) Int. Cl.
*E21B 49/08* (2006.01)

(52) U.S. Cl.
CPC ..... *E21B 49/081* (2013.01)

(58) Field of Classification Search
CPC ..... E21B 49/00; E21B 49/10; E21B 49/081
USPC ..... 166/254
See application file for complete search history.

(56) References Cited

U.S. PATENT DOCUMENTS 4,936,139 A * 6/1990 Zimmerman ..... E21B 49/08 175/40
6,745,835 B2 * 6/2004 Fields ..... E21B 49/10 166/100
7,841,402 B2 11/2010 Georgi et al.
2005/0109538 A1 * 5/2005 Fisseler ..... E21B 17/1078 175/20
2007/0284099 A1 * 12/2007 DiFoggio ..... E21B 49/08 166/264
2010/0095758 A1 * 4/2010 Georgi ..... E21B 49/083 73/152.28

(Continued)

FOREIGN PATENT DOCUMENTS

JP 4793637 B2 10/2011
KR 10-2011-0108701 A 10/2011

(Continued)

*Primary Examiner* — Taras P Bemko
(74) *Attorney, Agent, or Firm* — Lewis Roca Rothgerber Christie LLP

(57) ABSTRACT

Disclosed are an apparatus for sampling water in a borehole and a method thereof. The apparatus includes a water sampling cylinder to sample the water in the borehole; a first camera to monitor the water sampling cylinder and a sample discharging part provided in the borehole; a first motor to insert the water sampling cylinder into the sample discharging part; a vacuum vessel to receive a sample input from the water sampling cylinder; a waterproof member having a hole serving as a passage through which the water sampling cylinder moves back and forth; and a supporting member that urges the waterproof member closely to the sample discharging part to prevent foreign substances from being introduced into the borehole. The first motor includes a plurality of protrusions meshed with a plurality of grooves provided in the water sampling cylinder.

6 Claims, 7 Drawing Sheets

(56) References Cited

U.S. PATENT DOCUMENTS

2010/0258304 A1* 10/2010 Hegeman ..... E21B 47/10
166/250.01

FOREIGN PATENT DOCUMENTS

KR 10-2012-0014310 2/2012
KR 10-2012-0074489 7/2012

* cited by examiner

APPARATUS FOR SAMPLING WATER IN BOREHOLE, AND METHOD THEREOF

CROSS-REFERENCE TO RELATED APPLICATION

This application claims the benefit under 35 U.S.C. §119 of Korean Patent Application No. 10-2013-0076468 filed on Jul. 1, 2013 in the Korean Intellectual Property Office, the entirety of which disclosure is incorporated herein by reference.

BACKGROUND OF THE INVENTION

1. Field of the Invention

The present invention relates to an apparatus for sampling water in a borehole, which is capable of accurately collecting samples while preventing introduction of foreign substances into the borehole and capable of controlling the sampling speed by monitoring the situation of collecting samples at a target depth in the borehole, and a method thereof.

2. Background of Related Art

In general, groundwater pollution is seriously harmful to human beings, in particular, when human beings drink the polluted groundwater.

Meanwhile, a groundwater pollution source may be introduced into the groundwater from ground surface through a borehole. In addition, a pollution source, which is introduced into an underground not through the borehole, may encounter with the borehole while flowing along a stratum interface, a fault plane or a fractured zone, so that the pollution source may be introduced into the groundwater.

The pollution source described above is not introduced into the groundwater through any portions of the borehole, but introduced into the groundwater only at the positions at which the stratum interface, fault plane or fractured zone encounter with the borehole.

There is a related art for the present invention, such as Korean Unexamined Patent Publication No. 2012-0014310 (published on Feb. 17, 2012) entitled "Apparatus and method for groundwater sampling using hydraulic couplers". In the apparatus disclosed in the related art, couplers are connected to both ends of a water sampling pipe made of a metal. In case of positioning a sampler at a target depth, a socket and a plug constituting the coupler are connected to each other to open both ends of the sampler in order to allow groundwater to freely flow in/out. Thereafter, at the target depth, the sockets or plugs are permitted to be separated from the couplers at the both ends of the water sampling pipe by using a lift device, so that the both ends of the water sampling pipe are sealed to simultaneously take groundwater samples at multiple target depths.

However, according to the apparatus and method for groundwater sampling using hydraulic couplers of the related art which can simultaneously sample groundwater at multiple target depths, it is difficult to accurately collect a sample at a target depth. In addition, it is very difficult to monitor the situation of collecting the samples. Further, it is difficult to arbitrarily control the sampling rate to control an amount of sample.

In addition, according to the apparatus and method for groundwater sampling using hydraulic couplers of the related art which can simultaneously sample groundwater at multiple target depths, a foreign substance may be introduced into the collected sample.

SUMMARY OF THE INVENTION

The present invention has been made to solve the above problems occurring in the related art, and an object of the present invention is to provide an apparatus for sampling water in a borehole, which is capable of collecting a sample while preventing introduction of foreign substances into the borehole at a target depth and capable of controlling the sampling speed by monitoring the situation of collecting the sample in real time.

Another object of the present invention is to provide a method of sampling water in a borehole which is capable of collecting a sample while preventing introduction of foreign substances into the borehole at a target depth and capable of controlling the sampling speed by monitoring the situation of collecting the sample in real time.

To achieve the above-described objects, according to an embodiment of the present invention, there is provided an apparatus for sampling water in a borehole. The apparatus includes a water sampling cylinder to sample the water in the borehole; a first camera to monitor the water sampling cylinder and a sample discharging part provided in the borehole; a first motor to insert the water sampling cylinder into the sample discharging part; a vacuum vessel to receive a sample input from the water sampling cylinder; a waterproof member having a hole serving as a passage through which the water sampling cylinder moves back and forth; and a supporting member that urges the waterproof member closely to the sample discharging part to prevent foreign substances from being introduced into the borehole, wherein the first motor includes a plurality of protrusions meshed with a plurality of grooves provided in the water sampling cylinder.

The apparatus for sampling water in a borehole further includes a second camera to monitor an amount of the sample received in the vacuum vessel and the water sampling cylinder further includes a suction device to draw the sample into the vacuum vessel.

In addition, the vacuum vessel includes a sensor to sense an amount of the sample, and the borehole includes at least one door provided at every predetermined depth of the borehole and inserted into the borehole while being pushed by the water sampling cylinder.

Meanwhile, according to another embodiment of the present invention, there is provided a method of sampling water in a borehole. The method includes A) allowing a water sampling apparatus to go down in the borehole; B) determining whether a water sampling cylinder of the water sampling apparatus is enabled to dock with a sample discharging part of the borehole; C) stopping the water sampling apparatus from going down and allowing a waterproof member to adhere closely to the sample discharging part to prevent foreign substances from being introduced into the sampling discharging part when the water sampling cylinder is enabled to dock with the sample discharging part; D) inserting the water sampling cylinder into the sample discharging part; E) sampling the sample into a vacuum vessel; F) determining whether an amount of the sample exceeds a predetermined amount; and G) releasing the docking of the water sampling cylinder with the sample discharging part when the amount of the sample exceeds the predetermined amount.

The step B) is performed based on an image provided from a first camera which photographs the water sampling cylinder and the sample discharging part, and the step D) is performed by operating a first motor connected to the water sampling cylinder.

In addition, the step E) is performed by using a vacuum pressure of the vacuum vessel communicating with the water sampling cylinder or by a suction device which draws the sample when the vacuum pressure is not suitable to perform the sampling, and the step F) is performed by monitoring the sample through a water level sensor or a second camera provided in the vacuum vessel.

The advantages and features of the present invention will be apparently comprehended by those skilled in the art based on the embodiments which are described in detail with reference to accompanying drawings.

Terms and words used in the specification and the claims shall not be interpreted as commonly-used dictionary meanings, but shall be interpreted as to be relevant to the technical scope of the invention based on the fact that the inventor may property define the concept of the terms to explain the invention in best ways.

According to various embodiments of the present invention, since the descent of the apparatus for sampling water in a borehole can be monitored in real time, the sample can be collected at an exact target depth.

In addition, according to various embodiments of the present invention, since the amount of collected sample can be monitored, the sampling speed can be controlled.

Meanwhile, according to various embodiments of the present invention, since the water sampling apparatus includes the supporting member and the waterproof member, a foreign substance can be prevented from being introduced into the sample.

DETAILED DESCRIPTION OF THE INVENTION

Figure 1:
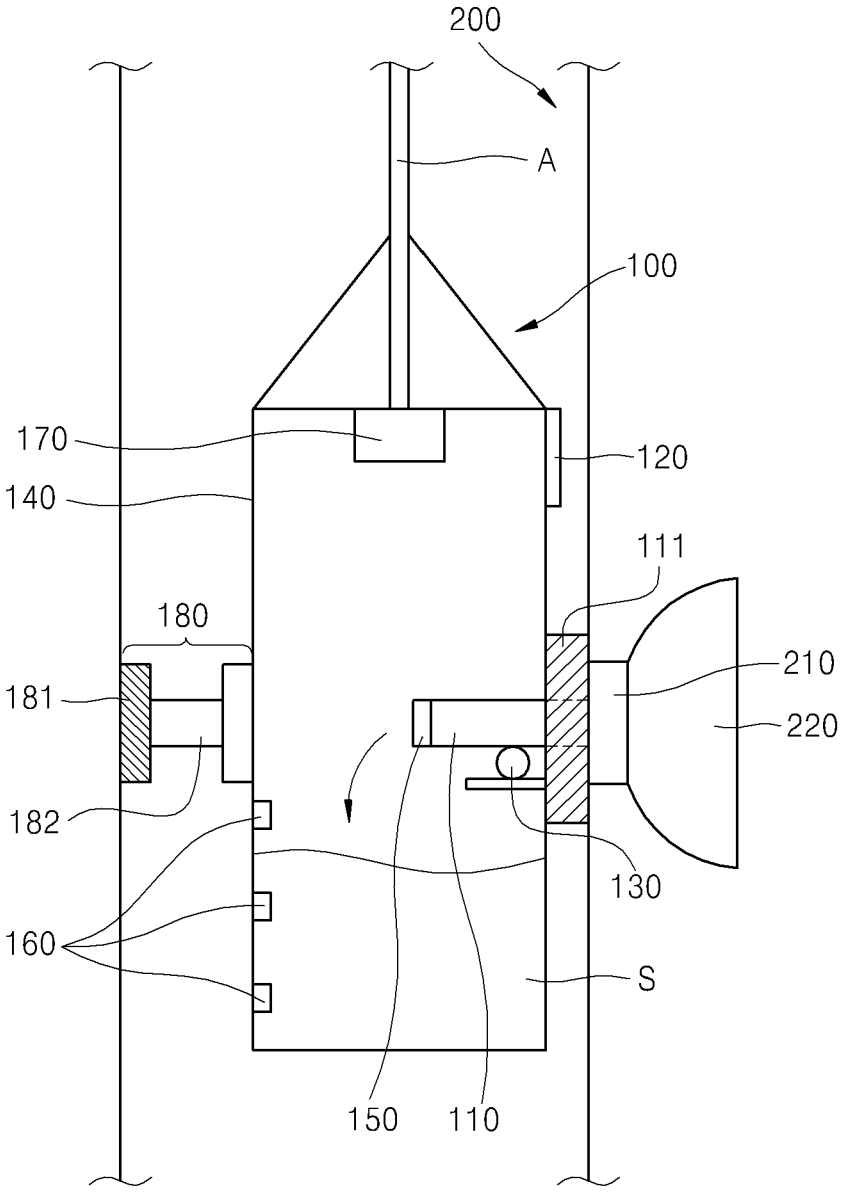
FIG. 1 is a view showing an apparatus for sampling water in a borehole according to an embodiment of the present invention.

The objects, the specific advantages, and the novel features of the present invention will be apparently comprehended by those skilled in the art based on the embodiments, which are detailed later in detail, together with accompanying drawings. In the following description, the same reference numerals will be used to refer to the same elements throughout the drawings. Although the terms "first" and "second" may be used in the description of various elements, the embodiment is not limited thereto. The terms "first" and "second" are used to distinguish one element from the other elements.

As used herein, the singular forms "a", "an" and "the" are intended to include the plural forms as well, unless the context clearly indicates otherwise. In the following description, when a predetermined part "includes" a predetermined component, the predetermined part does not exclude other components, but may further include other components if there is a specific opposite description.

In FIGS. 1 to 7, the same reference numerals will be used to refer to the same elements.

The basic principle of the present invention is to provide a water sampling cylinder which is enabled to protrude from or be inserted into the water sampling apparatus in order to sample water at a target depth of a borehole.

First, a sample S used in the embodiment of the present invention refers to groundwater, so the sampling of water has the same meaning as the collecting of a sample.

In the following description, if detailed description about well-known functions or configurations may make the subject matter of the disclosure unclear, the detailed description will be omitted.

Hereinafter, a preferable embodiment according to the present invention will be described with reference to accompanying drawings in detail.

FIG. 1 is a view showing an apparatus for sampling water in a borehole according to an embodiment of the present invention.

Referring to FIG. 1, the apparatus 100 for sampling water in a borehole 200 includes a water sampling cylinder 110 for collecting a sample S in the borehole 200, a first camera 120 for monitoring the water sampling cylinder 110 and a sample discharging part 210 provided in the borehole 200, a first motor 130 for inserting the water sampling cylinder 110 into the sample discharging part 210, and a vacuum vessel 140 for receiving the sample S input through the water sampling cylinder 110.

The apparatus 100 for sampling water in a borehole according to an embodiment of the present invention depicted in FIG. 1 will be described as follows.

First, the first camera 120 is included in the apparatus 100 for sampling water in the borehole 200.

Figure 2:
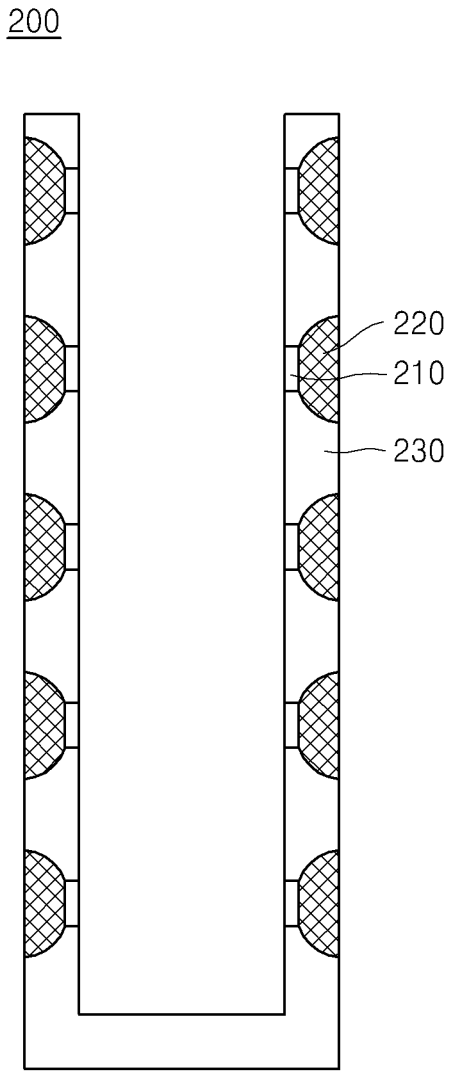
FIG. 2 is a sectional view showing a borehole according to an embodiment of the present invention.

The borehole 200 according to an embodiment of the present invention is configured as shown in FIG. 2.

FIG. 2 is a sectional view showing the borehole 200 according to an embodiment of the present invention.

Referring to FIG. 2, the borehole 200 according to an embodiment of the present invention includes the sample discharging part 210, a sample storing part 220 and a case 230.

The borehole 200 is filled with groundwater or a foreign substance such as polluted air. Thus, the sample discharging part 210 is ordinarily closed to prevent a foreign substance from be introduced into the sample storing part 220 therethrough.

That is, while a door of the sample discharging part 210 is ordinarily closed by an internal pressure of the sample storing part 220, the door is opened by an external force of the water sampling cylinder 110.

The sample storing parts 220 may be encased in the case 230 at every predetermined height. In this case, it is preferable to allow the sample storing part 220 to have a structure by which ground water may flow from an outside of the borehole 200 therein.

Again, referring to FIG. 1, the first camera 120 is provided over the water sampling cylinder 110 and photographs the water sampling cylinder 110 and the sample discharging part 210 in real time to transmit the image to an outside through a supporting cable A, so that the water sampling cylinder 110 and the sample discharging part 210 are monitored.

Preferably, the supporting cable A, which is provided on an upper portion of the water sampling apparatus 100 to prevent the water sampling apparatus 100 from falling down, includes a cable for transmitting the image and supplying power.

Meanwhile, the supporting cable A may be fabricated of urethane or Kevlar, or in a conduit tube.

When it is determined as a result of monitoring the image transmitted from the first camera 120 that the water sampling cylinder 110 is enabled to dock with the sample discharging part 210, the water sampling apparatus 100 is stopped from going down the borehole 200 any further.

Then, the supporting member 180 provided at a rear surface of the water sampling apparatus 100 is driven.

Figure 3:
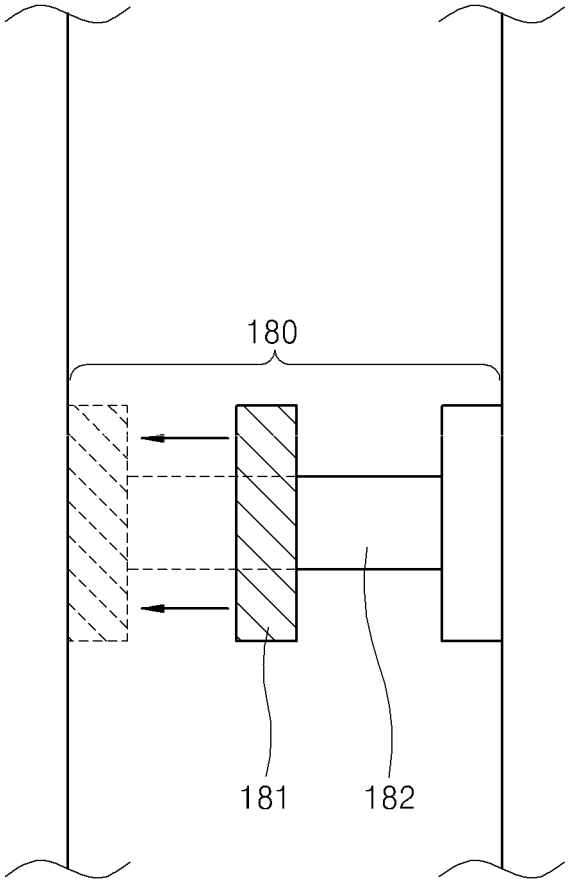
FIG. 3 is an enlarged view illustrating an operation of the supporting member of FIG. 1.

FIG. 3 is an enlarged view illustrating an operation of the supporting member 180 of FIG. 1.

Referring to FIGS. 1 and 3, the supporting member 180 includes a supporting part 181 and a supporting bar 182.

The water sampling apparatus 100 is stopped from moving up or down and the supporting bar 182 is driven at a dockable position.

Then, the supporting bar 182 slowly moves toward an inner wall of the borehole 200 so that the supporting part 181 provided at an end of the supporting bar 182 adheres closely to the inner wall of the borehole 200.

Preferably, the supporting part 181 may be formed of rubber. If it is possible to allow the supporting part 181 to adhere closely to the inner wall of the borehole 200, the supporting part 181 may be formed of synthetic resin, steel, or nonferrous metal, but the embodiment is not limited thereto.

When the supporting bar 182 is controlled to allow the water sampling cylinder 110 to dock with the sample discharging part 210 after the supporting part 181 adheres closely to the inner wall of the borehole 200, the water sampling apparatus 100 slowly moves in an opposite direction to the supporting part 181.

When it is determined based on the image provided in real time from the first camera 120 that the waterproof member 111 adheres closely to the sample discharging part 210, the supporting bar 182 is stopped moving.

Preferably, the supporting bar 182 includes a driving member such as a motor (not shown) for moving the supporting bar 182.

Thereafter, the first motor 130 connected to the water sampling cylinder 110 is driven such that the water sampling cylinder 110 is induced to be inserted into the sample discharging part 210.

The waterproof member 111 is provided around the water sampling cylinder 110.

Figure 4:
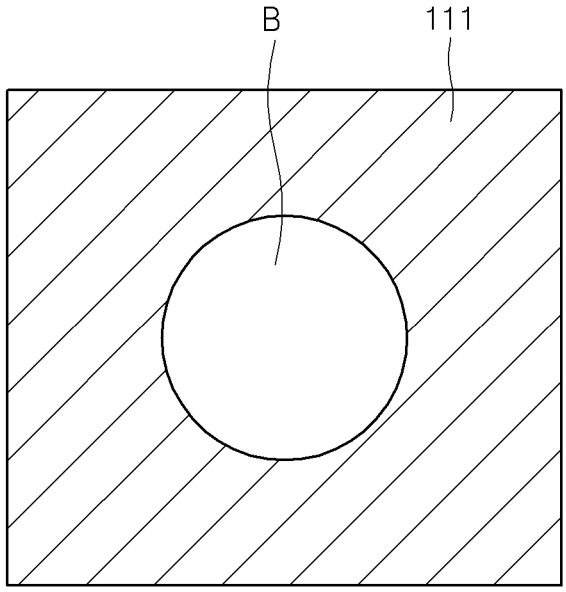
FIG. 4 is a sectional view showing a waterproof member according to an embodiment of the present invention.

FIG. 4 is a sectional view showing the waterproof member 111 according to an embodiment of the present invention.

Referring to FIG. 4, the waterproof member 111 according to an embodiment of the present invention includes a hole B through which the water sampling cylinder 110 moves.

Thus, the water sampling cylinder 110 is inserted into the hole B of the sample discharging part 210 and the hole B is used as a passage through which the water sampling cylinder 110 is inserted into the water sampling apparatus 100.

The waterproof member 111 is provided to prevent a foreign substance in the borehole 200 from being introduced into the sample discharging part 210. Rubber is suitable to form the waterproof member 111, but the embodiment is not limited thereto.

Meanwhile, when the water sampling cylinder 110 is inserted into the sample discharging part 210, a sample is collected through the sample discharging part 210 by a pressure of the vacuum vessel 140.

Figure 5:
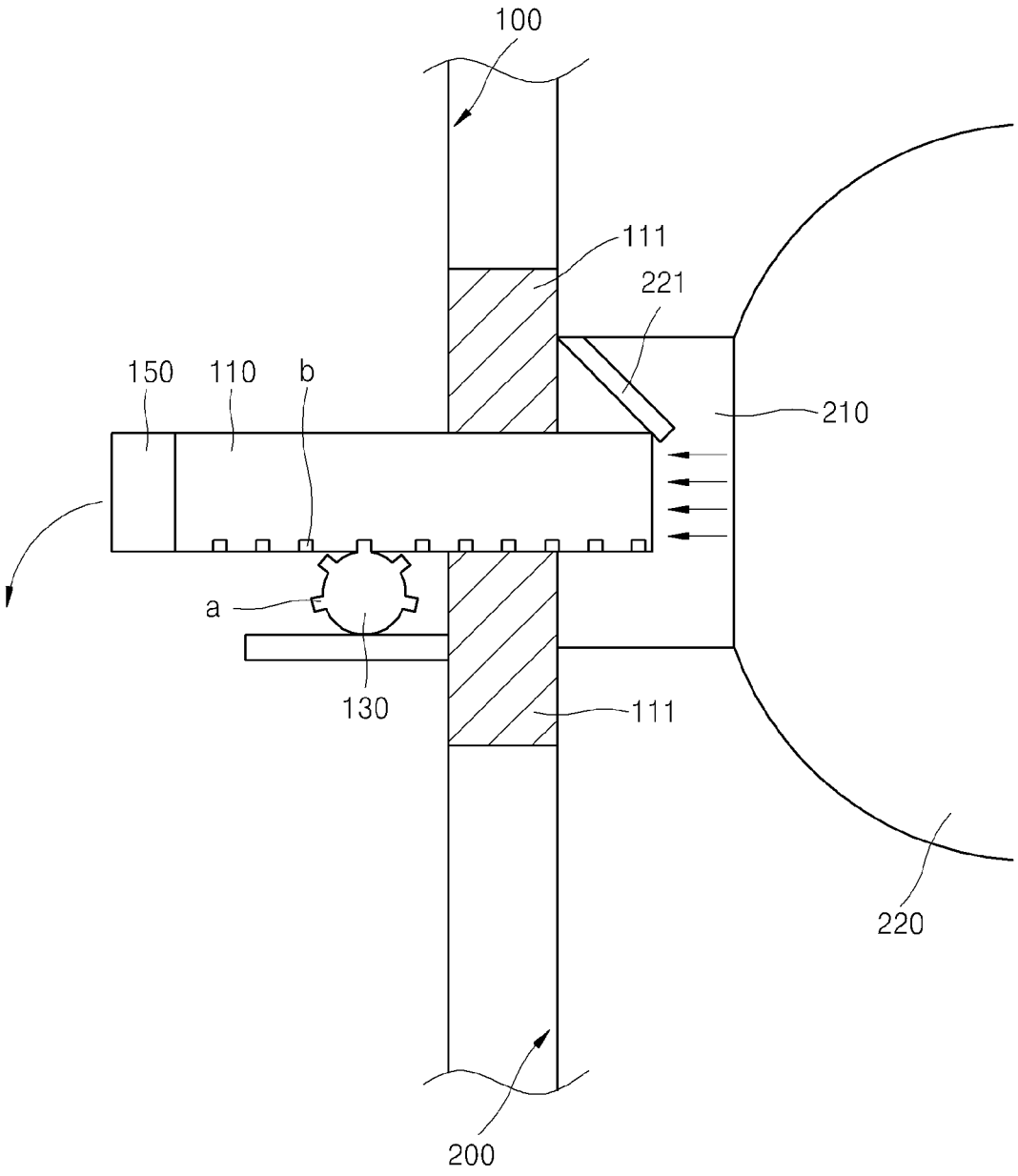
FIG. 5 is a view showing in detail a water sampling cylinder and a sample discharging part of an apparatus for sampling water in a borehole according to an embodiment of the present invention.

Referring to FIG. 5, the docking of the water sampling cylinder and the sample discharging part according to an embodiment of the present invention will be described in detail.

FIG. 5 is a view showing in detail the water sampling cylinder and the sample discharging part of an apparatus for sampling water in a borehole according to an embodiment of the present invention.

Referring to FIG. 5, when it is determined that the water sampling cylinder 110 is enabled to dock with the sample discharging part 210 while the image transmitted in real time from the first camera 120 at a target depth is monitored, the water sampling apparatus 100 is stopped from moving down.

Then, when it is determined based on the image transmitted in real time from the first camera 120 that the waterproof member 111 adheres perfectly and closely to an inlet of the sample discharging part 210 by controlling the supporting member 180 so that a foreign substance in the borehole 200 is not introduced into the sample discharging part 210, the first motor 130 provided below the water sampling cylinder 110 is driven such that the water sampling cylinder 110 is controlled gradually to protrude.

In this case, the water sampling cylinder 110 moves forward through the hole B.

The first motor 130 is provided at a circumferential surface thereof with protrusions a in the form of a gear. The protrusions a are meshed with grooves b formed on a lower surface of the sample discharging part 210 to drive the sample discharging part 210 back and forth.

According to the control described above, as shown in FIG. 5, the water sampling cylinder 110 is inserted into the sample discharging part 210.

As the water sampling cylinder 110 is inserted into the sample discharging part 210 from an outside, the door 221 of the sample discharging part 210 closed by the inner pressure is pushed upward.

When it is determined that the water sampling cylinder 110 is suitably inserted into the sample discharging part 210 while the image provided in real time from the first camera 120 is monitored, the first motor 130 is stopped from being driven such that the water sampling cylinder 110 is stopped.

Next, in order to obtain a sample, a shield (not shown) is opened such that the water sampling cylinder 110 communicates with the vacuum vessel 140.

The shield is provided in the water sampling cylinder 110 such that the vacuum pressure of the vacuum vessel 140 is not lost to an outside.

When the shield is opened, the sample S of the sample storing part 220 is input into the vacuum vessel 140 by the inner pressure of the vacuum vessel 140.

The sample storing part 220 is encased into the case 230 of the borehole 200. The sample storing part 220 is a kind of groundwater storing space into which groundwater is introduced from an outside of the borehole 200.

An amount of sample S drawn into the vacuum vessel 140 is sensed by water level sensors 160 installed in the vacuum vessel 140 at every predetermined height.

When it is determined that a suitable amount of sample S is sampled based on the information about the amount of input sample S provided from the water level sensors 160, the shield is closed and the first motor 130 is controlled to be rotated in an opposite direction, such that the water sampling cylinder 110 is retracted to be inserted into the vacuum vessel 140.

Meanwhile, as well as the water level sensors 160, a second camera 170 is further installed in the vacuum vessel 140.

The second camera 170 photographs the inside of the vacuum vessel 140 and transmits the photographed image in real time. If the image is monitored, the amount of collected sample S may be estimated.

Thereafter, the water sampling apparatus 100 in the borehole 200 is allowed to move up, so that the collected sample S is obtained.

When it is determined through the water level sensors 160 and the second camera 170 that the collected sample S is small or the internal pressure is weak, the suction device 150, which is installed on a rear surface of the water sampling cylinder 110, may be driven such that the sample S is allowed to be drawn into the vacuum vessel 140. Specifically, the strength of the suction device 150 is controllable so that the speed of collecting the sample S may be increased according to the strength.

In this case, a wire (not shown), which is provided for the purpose of transmitting electric power or an electric signal for photographed image transmission or control signal transmission, is installed to the supporting cable A and preferably, is connected to equipment such as a monitor or a personal computer provided to an outside.

Although the embodiment has been described on the assumption that the sample is groundwater for the purpose of convenience of explanation, the sample may include air in addition to the groundwater.

Specifically, the water sampling apparatus 100 according to an embodiment of the present invention is suitable for sampling groundwater. The $CO_2$ concentration of the water sample is measured to determine a degree of pollution.

In order to prevent the water sampling cylinder 110 from being corroded, the water sampling cylinder 110 may be painted, may be variously plated, or may be formed of a material such as metal, alloy or resin, or glass.

The water sampling cylinder 110 may have various shapes such as a cylindrical shape or a rectangular shape. Preferably, the water sampling cylinder 110 has a cylindrical shape.

When the water sampling cylinder 110 is formed of glass, tempered glass is preferably used to form the water sampling cylinder 110 to prevent the water sampling cylinder 110 from being damaged.

Figure 6:
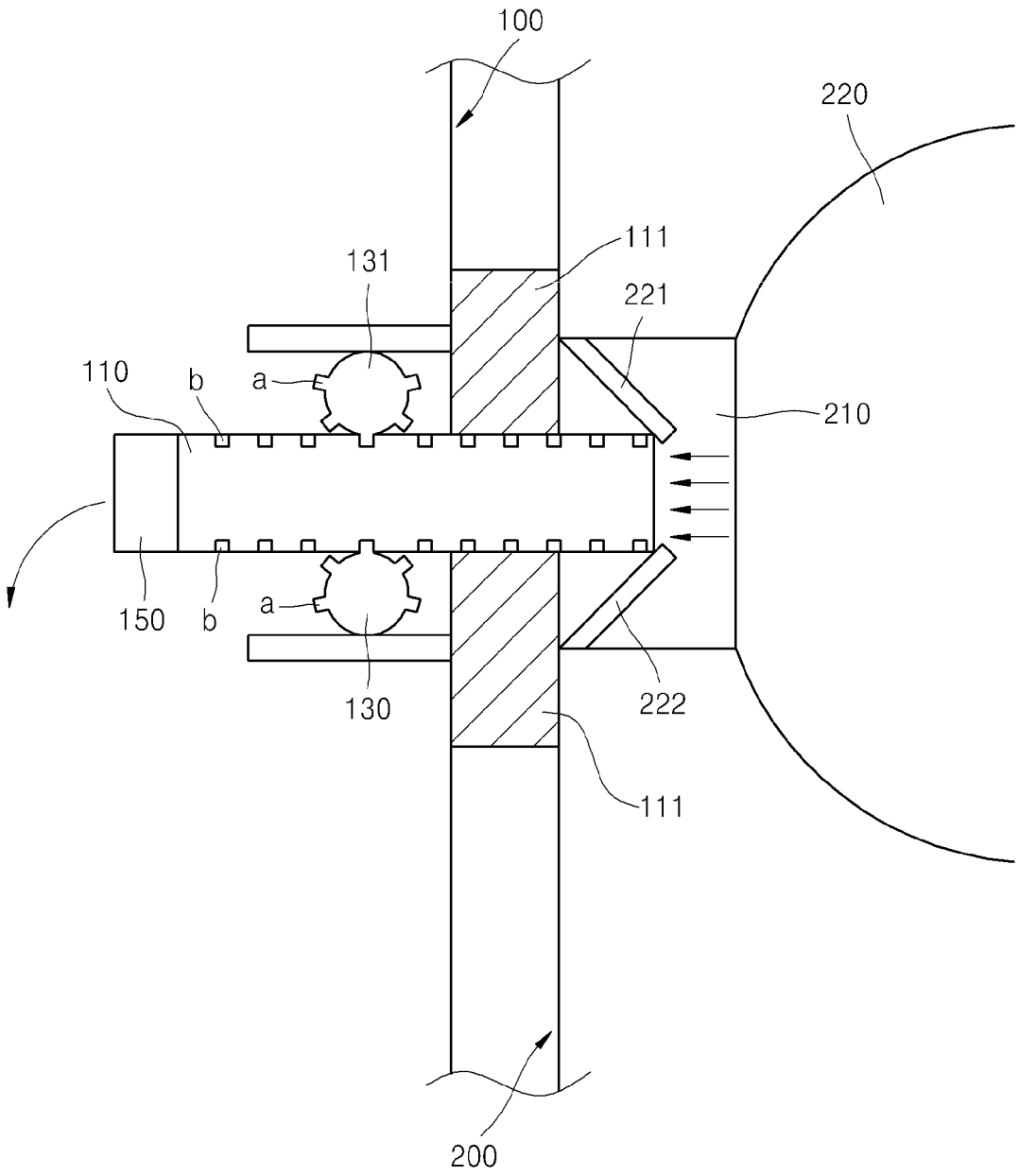
FIG. 6 is a view showing in detail a water sampling cylinder and a sample discharging part of an apparatus for sampling water in a borehole according to another embodiment of the present invention.

FIG. 6 is a view showing in detail the water sampling cylinder and the sample discharging part of an apparatus for sampling water in a borehole according to another embodiment of the present invention.

Referring to FIG. 6, when it is determined that the water sampling cylinder 110 is enabled to dock with the sample discharging part 210 while the image transmitted from the first camera 120 is monitored at a target depth, the water sampling apparatus 100 is stopped from going down the borehole 200 any further.

Then, when it is determined based on the image transmitted in real time from the first camera 120 that the waterproof member 111 adheres perfectly and closely to the inlet of the sample discharging part 210 by controlling the supporting member 180 so that a foreign substance in the borehole 200 is not introduced into the sample discharging part 210, the second motor 131 provided over the water sampling cylinder 110 is driven such that the water sampling cylinder 110 is controlled gradually to protrude.

Each of the first and second motors 130 and 131 is provided at a circumferential surface thereof with protrusions a in the form of a gear and the protrusions a are meshed with grooves b formed on the lower and upper surfaces of the sample discharging part 210, such that the first and second motors 130 and 131 drive the sample discharging part 210 back and forth.

That is, the insertion and protrusion of the water sampling cylinder 110 may be easily controlled through the motors 130 and 131 provided on the upper side and the lower side of the water sampling cylinder 110.

As shown in FIG. 6, the water sampling cylinder 110 is inserted into the sample discharging part 210 according to the above-described control.

As the water sampling cylinder 110 is inserted into the sample discharging part 210 from an outside, the first and second doors 221 and 222 of the sample discharging part 210 closed by the inner pressure are pushed upward (the first door 221) and downward (the second door 221), respectively.

When it is determined that the water sampling cylinder 110 is suitably inserted into the sample discharging part 210 while the image provided in real time from the first camera 120 is monitored, the first motor 130 is stopped from being driven such that the water sampling cylinder 110 is stopped.

Next, in order to obtain a sample, a shield (not shown) is opened such that the water sampling cylinder 110 communicates with the vacuum vessel 140.

The shield is provided in the water sampling cylinder 110 such that the vacuum pressure of the vacuum vessel 140 is not lost to an outside.

When the shield is opened, the sample S of the sample discharging part 210 is drawn into the vacuum vessel 140 by the inner pressure of the vacuum vessel 140.

An amount of sample S drawn into the vacuum vessel 140 is sensed by water level sensors 160 installed in the vacuum vessel 140 at every predetermined height.

When it is determined that a suitable amount of sample S is sampled based on the information about the amount of sample S provided from the water level sensors 160, the shield is closed and the first motor 130 is driven in an opposite direction, such that the water sampling cylinder 110 is retracted to be inserted into the vacuum vessel 140.

Meanwhile, as well as the water level sensors 160, a second camera 170 is further installed in the vacuum vessel 140.

The second camera 170 photographs the inside of the vacuum vessel 140 and transmits the photographed image in real time. If the image is monitored, the amount of collected sample S may be estimated.

Thereafter, the water sampling apparatus 100 in the borehole 200 is allowed to move up, so that the collected sample S is obtained.

When it is determined through the water level sensors 160 and the second camera 170 that the collected sample S is small or the internal pressure is weak, the suction device 150, which is installed on a rear surface of the water sampling cylinder 110, may be driven such that the sample S is allowed to be drawn into the vacuum vessel 140. Specifically, the strength of the suction device 150 is controllable so that the speed of collecting the sample S may be increased according to the strength.

In this case, a wire (not shown), which is provided for the purpose of transmitting electric power or an electric signal for photographed image transmission or control signal transmission, is installed to the supporting cable A and preferably, is connected to equipment such as a monitor or a personal computer provided to an outside.

Although the embodiment has been described on the assumption that the sample is groundwater, for the purpose of convenience of explanation, and it is possible to the sample may include air in addition to the groundwater.

In order to prevent the water sampling cylinder 110 from being corroded, the water sampling cylinder 110 may be painted, may be variously plated, or may be formed of a material such as metal, alloy, resin, or glass.

The water sampling cylinder 110 may have various shapes such as a cylindrical shape or a rectangular shape. Preferably, the water sampling cylinder 110 has a cylindrical shape.

When the water sampling cylinder 110 is formed of glass, tempered glass is preferably used to form the water sampling cylinder 110 to prevent the water sampling cylinder 110 from being damaged.

Meanwhile, the waterproof member 111 can prevent a foreign substance of the borehole 200 from being introduced, so that the pure sample S can be obtained at the target depth.

Figure 7:
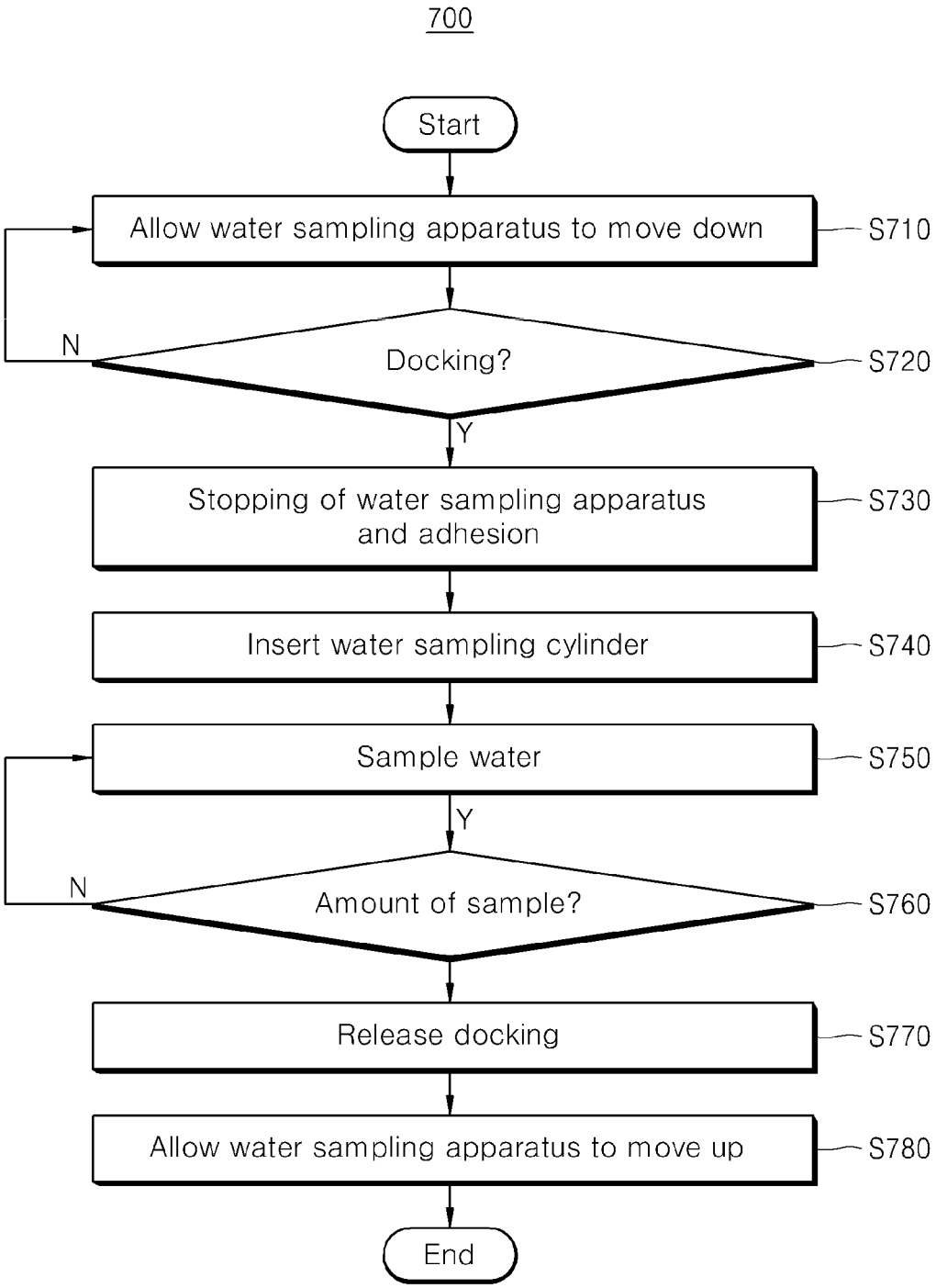
FIG. 7 is a flowchart illustrating a method of sampling water in a borehole according to still another embodiment of the present invention.

FIG. 7 is a flowchart illustrating a method of sampling water in a borehole according to still another embodiment of the present invention.

Referring to FIG. 7, a method 700 of sampling water in borehole according to another embodiment of the present invention includes step S710 of allowing the water sampling apparatus 100 to go down in the borehole 200; step S720 of determining whether the water sampling cylinder 110 of the water sampling apparatus 100 is enabled to dock with the sample discharging part 210 of the borehole 200; step S730 of stopping the water sampling apparatus 100 from going down and allowing the waterproof member to adhere closely to the sample discharging part to prevent a foreign substance from being introduced into the sampling discharging part when the water sampling cylinder is enabled to dock with the sample discharging part; step S740 of inserting the water sampling cylinder 110 into the sample discharging part 210; step S750 of putting the sample S into the vacuum vessel 140; step S760 of determining whether an amount of the sample S exceeds a predetermined amount; and step S770 of releasing the docking of the water sampling cylinder 110 with the sample discharging part 210 when the amount of the sample S exceeds the predetermined amount.

Hereinafter, the method 700 of sampling water in borehole according to another embodiment of the present invention depicted in FIG. 7 will be described in detail.

First, in step S710, the water sampling apparatus 100 is allowed to fall down in the borehole 200.

The supporting cable A is provided on an upper portion of the water sampling apparatus 100 to prevent the water sampling apparatus 100 from falling down.

Preferably, the supporting cable A includes a cable for transmitting the image and supplying electric power.

Then, it is determined whether the water sampling cylinder 110 of the water sampling apparatus 100 is enabled to dock with the sample discharging part 210 of the borehole 200.

The water sampling apparatus 100 includes the first camera 120 which transmits the image of the water sampling cylinder 110 and the sample discharging part 210 in real time.

Thus, by monitoring the transmitted image, it can be determined whether the water sampling cylinder 110 of the water sampling apparatus 100 is enabled to dock with the sample discharging part 210 of the borehole 200.

When it is impossible for the water sampling cylinder 110 to dock with the sample discharging part 210, the water sampling apparatus 100 is allowed to continuously fall down.

When it is determined that the water sampling apparatus 100 moves down beyond the target depth, the water sampling apparatus 100 may be moved up more.

If it is determined that the water sampling cylinder 110 is enabled to dock with the sample discharging part 210, the water sampling apparatus 100 is stopped from falling down and the waterproof member 111 is allowed to adhere closely to the inlet of the sample discharging part 210 in step S730.

Then, in step S740, the water sampling cylinder 110 is inserted into the sample discharging part 210.

In addition, the first motor 130 provided below the water sampling cylinder 110 is driven such that the water sampling cylinder 110 is controlled gradually to protrude.

Preferably, one motor may be provided on the water sampling cylinder 110 or two motors may be provided over or below the water sampling cylinder 110, respectively.

As the first motor 130 is driven, the water sampling cylinder 110 is inserted into the sample discharging part 210.

In step S750, the sample S is put into the vacuum vessel 140 by the inserted sampling cylinder 110.

The shield (not shown) is provided in the water sampling cylinder 110.

As the shield is opened or closed, the communication between the water sampling cylinder 110 and the vacuum vessel 140 is controlled.

Specifically, the shield is provided in the water sampling cylinder 110 such that the vacuum pressure of the vacuum vessel 140 is not lost to an outside.

When the shield is opened, the sample S in the sample discharging part 210 is drawn into the vacuum vessel 140 by the inner pressure of the vacuum vessel 140.

In step S760, it is determined whether the amount of sample S flowing into the vacuum vessel 140 through the water sampling cylinder 110 exceeds the predetermined amount.

To this end, the water level sensors 160 are installed in the vacuum vessel 140 at every predetermined height and the second camera 170 is further provided in the vacuum vessel 140.

That is, the water level sensors 160 may sense the amount of input sample S and the second camera 170 photographs the inside of the vacuum vessel 140 to transmit the photographed image in real time. If the image is monitored, the amount of collected sample S may be estimated.

In step S770, when the amount of the sample S exceeds the predetermined amount, the shield is closed, so that the communication between the water sampling cylinder 110 and the sample discharging part 210 is released and the docking of the water sampling cylinder 110 with the sample discharging part 210 is released.

Then, in step S780, the water sampling apparatus 100 is allowed to move up so that the sample S is obtained.

To the contrary, when the amount of the sample S does not exceed the predetermined amount, the process goes back to step S750 so that the sample S is continuously collected.

In addition, when the amount of the sample S does not exceed the predetermined amount, the suction device 150, which is installed on a rear surface of the water sampling cylinder 110, may be driven such that the inflow of the sample S may be accelerated.

Although the embodiment has been described on the assumption that the sample is groundwater, for the purpose of convenience of explanation, the sample may include air in addition to the groundwater.

In order to prevent the water sampling cylinder 110 from being corroded, the water sampling cylinder 110 may be painted, may be variously plated, or may be formed of a material such as metal, alloy or resin, or glass.

The water sampling cylinder 110 may have various shapes such as a cylindrical shape or a rectangular shape. Preferably, the water sampling cylinder 110 has a cylindrical shape.

Thus, by controlling the water sampling cylinder 110, the sample may be easily obtained at the target depth of the borehole 200.

As described above, although various examples have been illustrated and described, the present disclosure is not limited to the above-mentioned examples and various modifications can be made by those skilled in the art without departing from the scope of the appended claims. In addition, these modified examples should not be appreciated separately from technical spirits or prospects.

What is claimed is:

1. An apparatus for sampling water in a borehole, the apparatus comprising:

a water sampling cylinder to collect a sample of the water in the borehole;

a first camera provided over the water sampling cylinder to monitor the water sampling cylinder and a sample discharging part provided in the borehole in real time, wherein the first camera is configured to monitor whether the water sampling cylinder of the apparatus is enabled to dock with the sample discharging part in the borehole;

a first motor to insert the water sampling cylinder into the sample discharging part;

a vacuum vessel to receive the sample from the water sampling cylinder;

a waterproof member having a hole serving as a passage through which the water sampling cylinder moves back and forth;

a support member that urges the waterproof member against the sample discharging part to prevent foreign substances in the borehole from being introduced into the sample discharging part;

water level sensors installed in the vacuum vessel at a plurality of predetermined heights to monitor an amount of the sample received in the vacuum vessel; and a second camera installed in the vacuum vessel to monitor an amount of the sample received in the vacuum vessel in real time, wherein the first motor includes a plurality of protrusions meshed with a plurality of grooves provided in the water sampling cylinder.

2. The apparatus of claim 1, wherein the water sampling cylinder further comprises a suction device to draw the sample into the vacuum vessel.

3. The apparatus of claim 1, wherein the sample discharging part further comprises at least one door, the at least one door configured to be opened by the water sampling cylinder passing through the hole in the water proof member.

4. A method of sampling water in a borehole, the method comprising:

A) lowering a water sampling apparatus into the borehole;

B) determining whether a water sampling cylinder of the water sampling apparatus is enabled to dock with a sample discharging part of the borehole, wherein the step (B) is performed based on an image provided from a first camera which photographs the water sampling cylinder and the sample discharging part;

C) stopping the water sampling apparatus and urging a waterproof member against the sample discharging part to prevent foreign substances in the borehole from being introduced into the sampling discharging part when the water sampling cylinder is enabled to dock with the sample discharging part;

D) inserting the water sampling cylinder into the sample discharging part to collect a sample of the water in the borehole;

E) collecting the sample from the water sampling cylinder in a vacuum vessel;

F) determining whether an amount of the sample exceeds a predetermined amount by water level sensors and a second camera, wherein the water level sensors are installed in the vacuum vessel at a plurality of predetermined heights to monitor an amount of the sample received in the vacuum vessel, and the second camera is installed in the vacuum vessel to monitor an amount of the sample received in the vacuum vessel in real time; and G) releasing the water sampling cylinder from the sample discharging part when the amount of the sample exceeds the predetermined amount in the vacuum vessel determined by the water level sensors and the second camera.

5. The method of claim 4, wherein the step D) is performed by operating a first motor connected to the water sampling cylinder.

6. The method of claim 4, wherein the step E) is performed by using a vacuum pressure of the vacuum vessel communicating with the water sampling cylinder or by a suction device which draws the sample into the vacuum vessel when the vacuum pressure is not suitable to perform the collecting.

* * * * *